US005662022A

United States Patent [19]

Stoll

[11] Patent Number: 5,662,022

[45] Date of Patent: Sep. 2, 1997

[54] PISTON-ROD-LESS LINEAR DRIVE

[75] Inventor: Kurt Stoll, Esslingen, Germany

[73] Assignee: Festo KG, Esslingen, Germany

[21] Appl. No.: 641,180

[22] Filed: Apr. 30, 1996

[30] Foreign Application Priority Data

May 23, 1995 [DE] Germany ..... 295 08 517.7

[51] Int. Cl.[6] ..... F01B 31/12

[52] U.S. Cl. ..... 92/5 R; 92/88

[58] Field of Search ..... 92/5 R, 88

[56] References Cited

U.S. PATENT DOCUMENTS 4,656,457 4/1987 Brausfeld et al. ..... 92/5 R 4,819,546 4/1989 Ernst et al. ..... 92/5 R

*Primary Examiner*—F. Daniel Lopez

*Attorney, Agent, or Firm*—Hoffmann & Baron, LLP

[57] ABSTRACT

A pistonrod-less linear drive, whose housing having a longitudinal slot contains a drive part for longitudinal movement therein. A transmission member linked with the drive part projects right through the longitudinal slot to the outside. Adjacent to the two flanks of the longitudinal slot there is a respective resistance strip which extends in the longitudinal direction of the slot and is secured to the housing. A wiper contact arrangement is provided on the transmission member which simultaneously makes contact with both resistance strips and on longitudinal movement of the transmission member slides along the resistance strips. Connection means are provided to render possible connection of the two resistance strips with a position detecting and evaluating device.

5 Claims, 1 Drawing Sheet

PISTON-ROD-LESS LINEAR DRIVE

BACKGROUND OF THE INVENTION

The invention relates to a pistonrod-less linear drive comprising a housing possessing a longitudinal slot, a drive part arranged in the housing for longitudinal movement therein, and a transmission part which is connected with the drive part and extends through the longitudinal slot to the outside.

THE PRIOR ART.

A linear drive of this type in the form of a so-called slotted cylinder is disclosed in the German patent publication 4,137,789 C2. This drive comprises a drive part constituted by a piston, which under the action of a fluid performs linear motion which outside the housing is able to be transferred to the transmission member. A load to be conveyed can be connected with the transmission member.

In the case of many applications it is desirable for the position of the drive part or, respectively, of an object to be shifted with the aid of the linear drive, to be detected or at least however for certain control operations to be caused to take place in a manner coordinated with certain axial positions. It would be possible to ensure such coordination in the case of the known linear drive by using sensors, such as sensors of conventional design like reed switches, arranged externally on the housing. However this would necessitate the provision of special-purpose attachment means and it would reduce the compactness of the overall arrangement. Furthermore there is the danger that sensors mounted in this manner might well be damaged by moving parts if not properly handled.

SHORT SUMMARY OF THE INVENTION

One object of the invention is to is to provide a pistonrod-less linear drive of the type initially mentioned which while on the one hand possessing compact dimensions, on the other hand renders possible reliable detection of the position of the drive part or, respectively, of the parts connected therewith.

In order to achieve these and/or other objects appearing from the present specification, claims and drawings, in the present invention adjacent to the two flanks of the slot a respective resistance strip extending in the longitudinal direction of the slot is arranged secured to the housing, a wiper contact arrangement is provided on the transmission member adapted to be in contact with both resistance strips simultaneously and during longitudinal motion of the transmission member to slide on the resistance strips, and electrical lead means are provided for the connection of the two resistance strips with a position detecting and evaluating means.

It is in this manner that the position of the drive part and of all parts connected with the same may be reliably detected using the potentiometer principle. In accordance with the instantaneous longitudinal position there will be current flow paths of different length affecting the electrical resistance, by way of which, using the evaluating means, the instantaneous relative position of the transmission member and the housing can be ascertained. By integration of the position detecting measures or means adjacent to the longitudinal slot the compact dimensions of the linear drive are not impaired. The individual components may be accommodated in a well protected fashion. Furthermore, manufacture at an economic price is possible.

Further advantageous developments of the invention are defined in the claims.

It is preferred for the resistance strips to be accommodated in longitudinal grooves, which are formed in the flanks of the longitudinal slot. This means that the slot width need not be altered at all, this also applying for the overall width of the transmission member, which in operation is relatively heavily loaded.

The wiper contact arrangement may conveniently comprise two wiper contacts, which are each biased resiliently against one of the resistance strips and are in electrical contact with one another. During linear movement of the transmission member the wiper contacts slide on the respectively associated resistance strip, the resilient biasing effect ensuring a reliable electrical contact at all times.

The resistance strips may be directly connected with one or more cables, which serve as lead means for connection with the electrical evaluating device. Simpler handling is however rendered possible with a further development, in which the connection means are arranged in an axial end part of the housing, same on the one hand being connected with the resistance strips and on the other hand rendering possible, as required, a detachable connection of the evaluating device. Such connection means are preferably designed in the form of plug-type connection means, which render the connection of the evaluating device using simple plug connecting means.

It is convenient for the connection means to be arranged on the end face of the linear drive. In the case of fluid power operated linear drives the ports for the supply and discharge of the drive fluid are also conveniently located on such face.

The design of the invention is not only possible in the case of fluid operated linear drives. For instance, a position detecting means using the principle in accordance with the invention could also be provided for electrically operated linear drives.

In what follows the invention will be described in detail with reference to the accompanying drawings.

LIST OF THE SEVERAL VIEWS OF THE FIGURES

DETAILED ACCOUNT OF WORKING EMBODIMENT OF THE INVENTION

Figure 1:
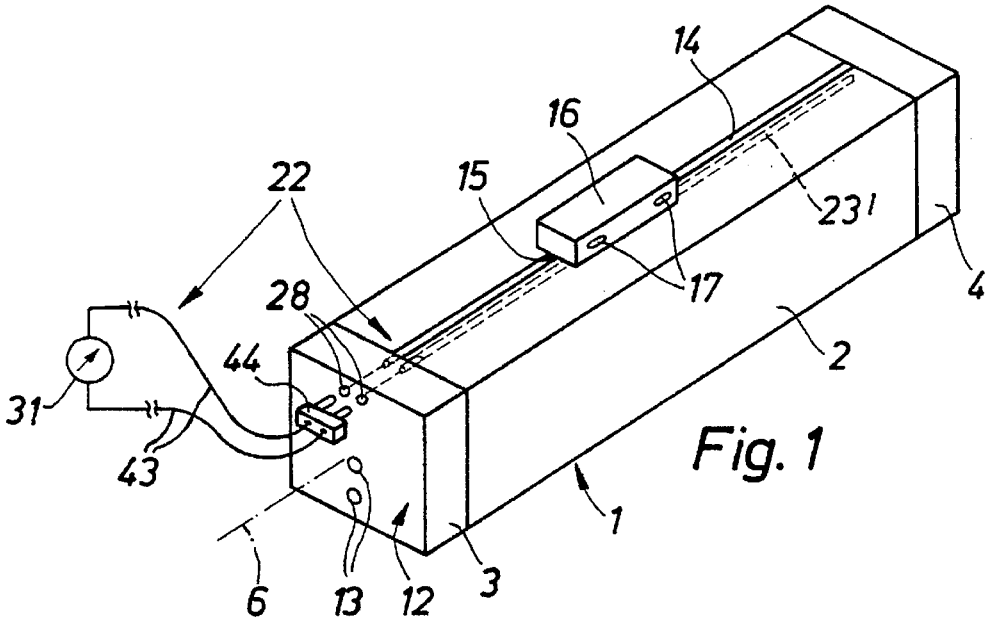
FIG. 1 shows a first constructional form of the linear drive of the invention in a diagrammatic and perspective representation.
Figure 2:
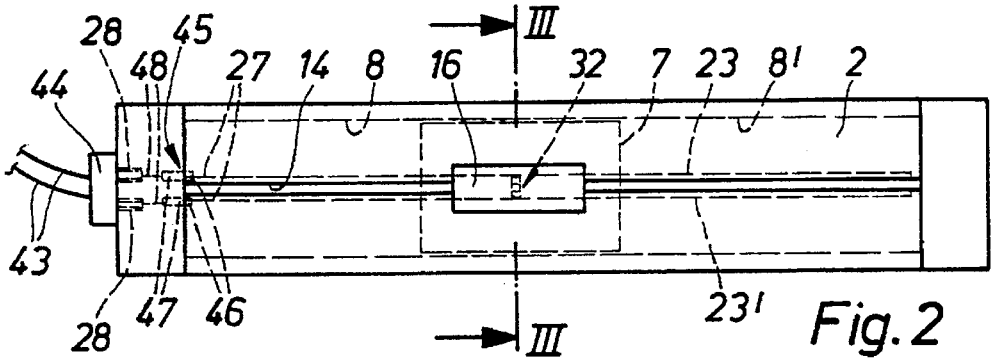
FIG. 2 shows a plan view of the linear drive of FIG. 1.
Figure 3:
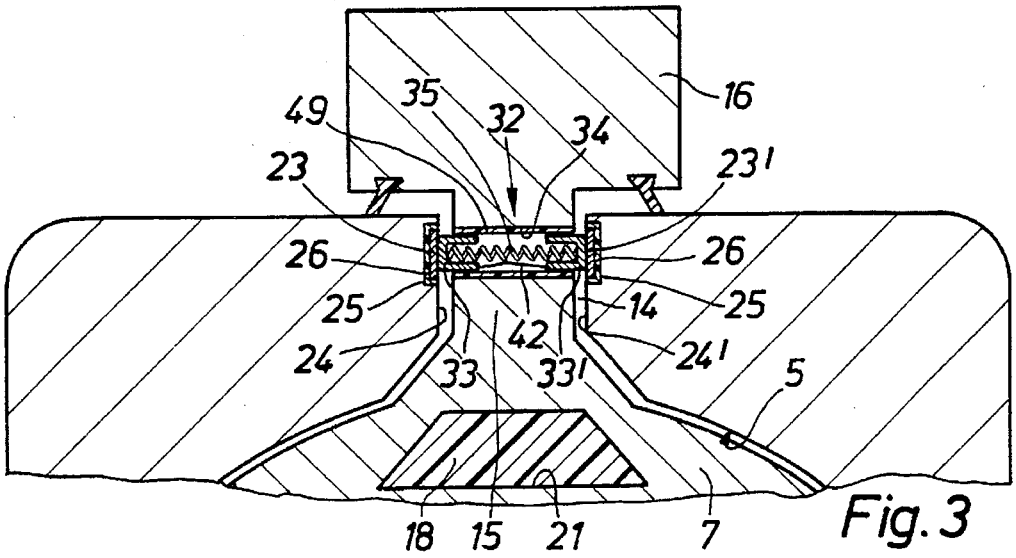
FIG. 3 shows the linear drive of FIGS. 1 and 2 in a cross section taken on the line III—III adjacent to the longitudinal slot.

In the case of the linear drive, taken here by way of example, it is a question of a fluid operated pistonrod-less power cylinder. Apart from the measures yet to be explained for position detection its design may be according to linear drive in accordance with said German patent publication 4,137,789 C2. The content of such prior publication is incorporated herein by reference and it is sufficient in the present case to briefly describe the basic structure thereof.

The linear drive possesses an elongated housing 1 composed of a middle part constituted by a tube body 2 and two connection end pieces 3 and 4 mounted on the ends of the tube body 2.

In the interior of the tube body 2 there is a runner chamber of cylindrical form and extending in the longitudinal direction 6 of the housing, wherein a runner or drive part 7 is arranged able to move longitudinally in relation to the housing 2. The drive part 7 is in the present case a piston, which divides the runner chamber 5 axially into two working spaces 8 and 8'. Each working space 8 and 8' is in communication with a duct, both ducts opening jointly at the end 12 of the one end piece 3. The openings form connection ports 13 for the supply and discharge of an operating fluid by means of which the drive part 7 may be driven to perform as linear movement in the longitudinal direction 6 of the housing.

At one point of its periphery the tube body 2 or barrel possesses a longitudinal slot 14 extending along the full length of the tube. This slot extends through the housing wall, which delimits the runner chamber 5 peripherally, in a radial direction, it opening radially inward toward the runner chamber 5 and radially outward to the surroundings of the housing 1. An elongated and narrow transmission member 15, which is mounted on the drive part 7, extends through the longitudinal slot 14 and projects to the outside, where it is permanently connected with a diagrammatically indicated drive dog 16. The drive dog 16 for its part is suitable for connection with a structure to be moved, as for example a component of a materials handling system. Suitable attachment holes for this are indicated at 17.

The drive part 7, the transmission member 15 and the drive dog 16 together constitute a moving unit. On shifting the drive part 7, the drive dog 16 and accordingly the structure attached thereto are synchronously moved as well.

In order to prevent escape of operating fluid through the longitudinal slot 14 same is provided with a flexible sealing tape 18. Normally it covers the longitudinal slot 14 from the inside in a sealing fashion. It is merely adjacent to the drive part 7 or runner that it is moved clear of the longitudinal slot 14 inward in order to permit the passage of the transmission member 15. The sealing tape 18 is in this respect extended through a recess 21 in the drive part 7 or in the transmission member 15.

The linear drive is furnished with a position detecting device generally referenced 22. During operation same renders possible the ascertainment of the instantaneous position of the above mentioned moving unit 7, 15 and 16 in relation to the housing 1.

The said position detecting device 22 firstly comprises two resistance strips 23 and 23' manufactured of electrically conducting material. One respective strip of such resistance strips 23 and 23' is fixed in relation to the housing at one of the flanks 24 and 24' of the longitudinal slot 14. Each respective resistance strip 23 and 23' extends in the longitudinal direction of the slot, it extending at least substantially along the full length of the slot.

In order not to render the slot unnecessarily narrow, each resistance strip 23 and 23' is at least in part, and preferably completely, received in a longitudinal groove 25, which is formed in the respective slot flank 24 and 24' laterally delimiting the longitudinal slot 14. Each respective longitudinal groove 25 makes a contribution to an exactly parallel alignment of the associated resistance strip 23 and 23' and during manufacture of the tube body 2 it may be directly formed in the course of an extrusion operation.

The housing 1 will normally consist of metal, as for example of aluminum material. Between each respective resistance strip 23 and 23' and the housing material it is therefore convenient to provide an insulating layer 26 consisting of electrically insulating material. It may be a permanent component of the resistance strip 23 and 23'.

The end parts 27, associated with the one end piece 3, of the resistance strips 23 and 23' are joined to electrical connection or lead means 28 arranged in fixed relationship to the housing. Such means render possible the connection of a position detecting and evaluating device 31, which is depicted diagrammatically in FIG. 1. The end parts, associated with the other end piece 4, of the resistance strips 23 and 23' extend freely into the surroundings.

On the transmission member 15 and within the longitudinal slot 14 a wiper contact arrangement 32 is provided. It is simultaneously in contact with both resistance strips 23 and 23'. During longitudinal movement of the transmission member 15 the wiper contact arrangement 32 will run along the two resistance strips 23 and 23'.

Adjacent to the transmission member 15 the wiper contact arrangement 32 accordingly constitutes an electrical connection between the two resistance strips 23 and 23'. The longitudinal slot 14 is practically spanned over. The point of electrical connection will vary in accordance with the longitudinal position of the transmission member 15 and will accordingly be dependent directly on the instantaneous relative position between the transmission member 15 and the housing 1.

Accordingly, using a potentiometer action or principle, it is possible to ensure a reliable, continuous ascertainment or detection of the said relative position. This in turn renders possible extremely accurate positioning of the structures to be moved with the linear drive.

The position detecting and evaluating device in the present example possesses an electrical power supply, not illustrated in detail, using which via the electrical connection means 28 a voltage may be supplied to the two resistance strips 23 and 23'. Thus current is caused to flow. From the voltage source the current flows via the one electrical connection means 28 to the one resistance strip 23, thence via the wiper contact arrangement 32 to the other resistance strip 23' and via the associated connection means back to the evaluating device 31. Controlling for the size of the current is the respectively acting electrical resistance, which is due to the resistance strips 23 and 23'. Such resistance is set by the axial length of the current carrying length sections of the resistance strips 23 and 23', which for its part depends on the instantaneous axial position of the wiper contact arrangement 32. The length of the current carrying resistance strip sections will increase with an increase in the distance of the transmission member 15, and the wiper contact arrangement mounted thereon, from the connection means 28. Dependent on the length of the current carrying strip sections there will be a different electrical resistance, something which is able to be registered in the position detecting and evaluating device 31 as a change in current. It is in this manner that the instantaneously detected amperage may serve as an indicator for the instantaneous position of sliding of the moving unit 7, 15 and 16 in relation to the housing 1. In case of need the control of the linear drive itself or of further devices may be performed in a manner dependent on certain positions.

It would be feasible to so design the arrangement that one of the resistance strips is directly formed by the flank of the slot. The return current could then flow on the one side of the longitudinal slot directly via the material of the housing.

The wiper contact arrangement 32 preferably possesses two mutually independent wiper contacts 33 and 33', which are arranged adjacent to the mutually opposite longitudinal sides of the rib-like transmission member 15. The design is such that each wiper contact 33 and 33' is on the one hand fixed to the transmission member 15 and on the other hand runs on the associated resistance strips 23 and 23' under a spring loading effect. Accordingly there is an elastic resiliency in the transverse direction of the longitudinal slot 14, such resiliency ensuring that the wiper contacts 33 and 33' are at all times in satisfactory contact with the resistance strips 23 and 23'.

The wiper contacts 33 and 33' may for example be in the form of strip spring-like contact elements. In the illustrated working embodiment of the invention each wiper contact 33 and 33' is designed in the form of a wiper shoe, both wiper contacts 33 and 33' being mounted for sliding motion athwart the slot in a guide hole 34 extending through the transmission member 15. Between the wiper contacts 33 and 33' there extends a spring device 35 constituted by a compression spring, such spring urging the two wiper contacts 33 and 33' outward against the associated resistance strips 23 and 23'.

The two wiper contacts 33 and 33' are electrically connected to one another, something which in the present case is ensured by the presence of a flexible electrical conductor 42, which is secured to the two wiper contacts 33 and 33'. It would also be possible to utilize the spring device 35 as an electrical connection conductor.

For electrical insulation the guide hole 34 is best lined with electrically insulating material 49.

The previously mentioned connection means 28 are preferably designed in the form of plug-type connection means and are arranged on the same end face 12 of the end piece 4 as illustrated, as is also the case for the connection ports 13 for the supply of fluid under pressure.

The position detecting and evaluating device 31 is connected via cables 43 with a complementary connection means 44, formed, for example, by a plug, such means being able to be detachably connected with the plug-type connection means 28 as a plug connection system.

It would be possible to train extensions of the resistance strips 23 and 23' through the associated end piece 3 and to cause them to terminate in the said connection means 28. In the illustrated working embodiment a design providing for greater ease of assembly is adopted. In this case in the transitional zone between the tube body 2 and the respective end piece 3 there is a plug connection device 45 which possesses first and second complementary connecting plugs 46 and 47. The first connecting plugs 46 are mounted at the end of the tube body 2 and at the ends of the resistance strips 23 and 23'. The second connecting plugs 47 are located opposite to them on the end piece 3 and are connected via internal electrical conductors with the connection means 28. On assembly of the housing 1 automatic production of contacts is consequently ensured, and furthermore it is easier to take the housing 1 apart should there be a defect.

Since both the ports for fluid under pressure and also the electrical connection terminals are arranged on the same end side of the housing 1, the linear drive is extremely user-friendly. It is preferably a question of a pneumatically operated linear drive.

The arrangement in accordance with the invention of a position detecting and evaluating device may be embodied in the case of other linear drives as well, which possess a transmission member extending through a longitudinal slot in the housing. For instance this could apply for electrical linear drives, in the case of which the drive part 7 is driven by an electric motor.

I claim:

1. A rod-less linear drive comprising a housing possessing a longitudinal slot, a drive part arranged in the housing for longitudinal movement therein, and a transmission part which is connected with the drive part and extends through the longitudinal slot to the outside, wherein on two internal flanks of the slot a respective resistance strip extends in the longitudinal direction of the slot and is secured to the housing, wherein the resistance strips are respectively secured in a longitudinal groove in the associated slot flank, a wiper contact arrangement is provided on the transmission member adapted to be in contact with both resistance strips simultaneously and during longitudinal motion of the transmission member slide on the resistance strips, and electrical lead means are provided for the connection of the two resistance strips with a position detecting and evaluating means.

2. The linear drive as set forth in claim 1, wherein the connection means are arranged on an axial end part of the housing, same being on the one hand connected with the resistance strips and on the other hand rendering possible detachable electrical connection of the position detecting and evaluating device.

3. The linear drive as set forth in claim 2, wherein the connection means are designed in the form of plug-type connection means.

4. The linear drive as set forth in claim 2, wherein the connection means are arranged on the end of the linear drive.

5. A rod-less linear drive comprising a housing possessing a longitudinal slot, a drive part arranged in the housing for longitudinal movement therein, and a transmission part which is connected with the drive part and extends through the longitudinal slot to the outside, wherein on two flanks of the slot a respective resistance strip extends in the longitudinal direction of the slot and is secured to the housing, a wiper contact arrangement is provided on the transmission member adapted to be in contact with both resistance strips simultaneously and during longitudinal motion of the transmission member slide on the resistance strips, and electrical lead means are provided for the connection of the two resistance strips with a position detecting and evaluating means, wherein the wiper contact arrangement possesses two wiper contacts electrically connected together and said wiper contacts are mounted for sliding motion in a guide hole extending through the transmission member transversely and are urged resiliently by a spring means, arranged between the wiper contacts, against the respectively associated resistance strip.

* * * * *